US011352584B2

(12) United States Patent
Male et al.

(10) Patent No.: US 11,352,584 B2
(45) Date of Patent: Jun. 7, 2022

(54) LUBRICATING OIL COMPOSITIONS CONTAINING PRE-CERAMIC POLYMERS

(71) Applicant: Infineum International Limited, Abingdon (GB)

(72) Inventors: Nigel A. Male, Salisbury (GB); Stuart A. Taylor, Reading (GB); Russell M. Thompson, Witney (GB); Anton Coulthurst, Oxford (GB)

(73) Assignee: Infineum International Limited, Oxford (GB)

( * ) Notice: Subject to any disclaimer, the term of this patent is extended or adjusted under 35 U.S.C. 154(b) by 109 days.

(21) Appl. No.: 15/900,844

(22) Filed: Feb. 21, 2018

(65) Prior Publication Data

US 2018/0237724 A1 Aug. 23, 2018

(30) Foreign Application Priority Data

Feb. 22, 2017 (EP) ..... 17157433

(51) Int. Cl.

| | |
|---|---|
| ***C10M 169/04*** | (2006.01) |
| ***C10M 101/00*** | (2006.01) |
| ***C10M 155/02*** | (2006.01) |
| ***C10M 139/04*** | (2006.01) |
| ***C10M 169/00*** | (2006.01) |
| ***C10M 107/50*** | (2006.01) |
| ***C10M 107/52*** | (2006.01) |
| *C10N 30/06* | (2006.01) |
| *C10N 40/25* | (2006.01) |

(52) U.S. Cl.

CPC ..... *C10M 169/041* (2013.01); *C10M 101/00* (2013.01); *C10M 107/50* (2013.01); *C10M 107/52* (2013.01); *C10M 139/04* (2013.01); *C10M 155/02* (2013.01); *C10M 169/00* (2013.01); *C10M 2203/003* (2013.01); *C10M 2223/045* (2013.01); *C10M 2227/04* (2013.01); *C10M 2229/02* (2013.01); *C10M 2229/052* (2013.01); *C10N 2030/06* (2013.01); *C10N 2040/255* (2020.05)

(58) Field of Classification Search

CPC ..... C10M 169/041; C10M 101/00; C10M 155/02; C10M 139/04; C10M 169/00; C10M 107/50; C10M 107/52; C10M 2203/003; C10M 2229/052; C10M 2227/04; C10M 2223/045; C10M 2229/02; C10N 2240/104; C10N 2230/06

See application file for complete search history.

(56) References Cited

U.S. PATENT DOCUMENTS

| | | | | |
|---|---|---|---|---|
| 1,183,512 | A | 5/1916 | Adamson | |
| 2,391,184 | A * | 12/1945 | Mikeska | C10M 137/10 508/441 |
| 2,570,719 | A * | 10/1951 | Rudel | C10M 171/004 508/204 |
| 3,230,242 | A * | 1/1966 | Fink | C07F 7/10 556/409 |
| 3,344,066 | A * | 9/1967 | Delphenich | C10M 7/00 508/136 |
| 5,162,558 | A | 11/1992 | Ardaud et al. | |
| 6,887,835 | B1 * | 5/2005 | Migdal | C10M 139/04 508/204 |
| 2002/0082176 | A1 | 6/2002 | Chambard et al. | |
| 2010/0294230 | A1 | 11/2010 | Raj et al. | |
| 2013/0196887 | A1 * | 8/2013 | Pettersen | C10M 169/04 508/155 |

FOREIGN PATENT DOCUMENTS

| | | |
|---|---|---|
| CN | 104177836 A1 | 12/2014 |
| EP | 3048146 A1 | 7/2016 |
| GB | 1183512 | 3/1970 |

OTHER PUBLICATIONS

Colombo, Paulo et al., "Polymer-Derived Ceramics: 40 Years of Research and Innovation in Advanced Ceramics", Journal of the American Ceramic Society, 93 [7] 1805-1837, (2010).

Paolo Colombo et al., Polymer-Derived Ceramics: 40 Years of Research and Innovation in Advanced Ceramics, J. Amer. Ceram. Soc., (20100000), vol. 93, No. 7, pp. 1805-1837.

* cited by examiner

*Primary Examiner* — Cephia D Toomer

(57) ABSTRACT

A lubricating composition comprises an oil of lubricating viscosity, a metal-free pre-ceramic polymer and one or more co-additives. The metal-free pre-ceramic polymer comprises a plurality of repeat units which do not contain oxygen. The pre-ceramic polymers provide the lubricating oil composition with antiwear properties. Also described is a method of lubricating an internal combustion engine and the use of a lubricating oil composition containing a pre-ceramic polymers to inhibit wear in an internal combustion engine.

54 Claims, No Drawings

LUBRICATING OIL COMPOSITIONS CONTAINING PRE-CERAMIC POLYMERS

This invention relates to lubricating oil compositions such as automotive lubricating oil compositions used to lubricate the crankcase of piston engines, such as gasoline (spark-ignited), diesel (compression-ignited) and gas engines. In particular, the invention relates to additives which provide lubricating oil compositions with antiwear properties.

Lubricants of all types have long made use of chemical additives to provide additional or enhanced properties which cannot be gained from the base lubricant itself. Among the different classes of additives are antiwear additives which commonly act by forming a physical or chemical boundary between lubricated surfaces thereby protecting those surfaces from wear. Antiwear additives are routinely added not only to oils for crankcase lubrication but also to transmission fluids, gear oils, cutting oils, trunk-piston engine oils (TPEO), marine diesel cylinder lubricants (MDCL) and other engine and machine lubricating oils, and to greases.

Phosphorus in the form of dihydrocarbyl dithiophosphate metal salts has been widely used for many years to provide lubricants with antiwear properties. Salts of alkali and alkaline earth metals, aluminium, lead, tin, molybdenum, manganese, nickel and copper have all found use but the overwhelmingly preferred salts are the zinc dihydrocarbyl dithiophosphate salts (ZDDP). These salts act by forming a phosphate glass layer on the lubricated surfaces which layer prevents the underlying material from being worn. However, stricter controls on the amount of phosphorus present in lubricants, particularly crankcase lubricants, has led to the need to find alternative materials which are free from phosphorus. A desired aim is thus to provide additives which can be used as partial or complete replacements for ZDDP.

Antiwear additives which do not contain phosphorus do exist. One example are the zinc dithiocarbamates such as those commercially available under the trade names Vanlube EZ and Vanlube AZ. However, zinc dithiocarbamates have the disadvantage that they can degrade the fluoroelastomer materials commonly used as seals in piston engines. Furthermore, it can be desirable to reduce the amount of metal contained in a lubricant. Commonly used antiwear additives such as ZDDP, zinc dithiocarbamates and similar compounds contain metals. There is thus an ongoing need to find further alternative antiwear additives which do not have the drawbacks of those currently in use.

The present invention provides lubricating oil compositions which contain a class of compounds which have hitherto not been used as additives for lubricating oil compositions. These compounds are able to provide lubricating oil compositions with excellent antiwear properties but they do not contain phosphorus and are also metal-free.

Pre-ceramic polymers are known in the art. For example, Colombo et al., in *J. Am. Ceram. Soc.,* 93 [7], 1805-1837 (2010) present a summary of several decades of research activity into pre-ceramic polymers, their synthesis, structures and industrial uses. The polymers have been widely used to produce ceramic articles and coatings by first forming the article or coating and then subjecting it to a pyrolysis, sintering or other thermal decomposition process, sometimes under an applied pressure. The main advantage of pre-ceramic polymers over more conventional ceramic formation via powder synthesis is the ease with which articles can be shaped and machined. This is because in the 'green' state (i.e. prior to pyrolysis) pre-ceramic polymers have sufficient structural integrity to allow precise forming and shaping using moulding techniques or by machining.

Contrastingly, articles produced via powder synthesis are structurally weak while in the 'green' state so cannot be shaped or machined in the same way. Pre-ceramic polymers may also be extruded or deposited as coatings.

The present invention is based upon the discovery that certain pre-ceramic polymers can be used to provide lubricating oil compositions with enhanced antiwear properties.

Accordingly, in a first aspect, the present invention provides a lubricating oil composition comprising a major amount of a lubricant and a minor amount of a metal-free pre-ceramic polymer, wherein the pre-ceramic polymer comprises a plurality of repeat units which do not contain oxygen, and wherein the lubricating oil composition further comprises one or more co-additives.

The pre-ceramic polymers used in the present invention are metal-free which means that the structure of the polymers does not contain any metal atoms, either in the main structural chains of the polymers or in any groups pendant from the main structural chains. There are also no metal atoms present in any capping or chain-terminating groups of the polymers.

The pre-ceramic polymers are comprised of a plurality of repeat units. These repeat units do not contain oxygen. This means that neither the main structural chains of the polymers nor any groups pendant from the main structural chains contain oxygen atoms. Oxygen atoms may however be present in any capping or chain-terminating groups of the polymers, as described hereinbelow.

In a preferred embodiment, the lubricating oil composition is an automotive lubricating oil composition useful to lubricate the crankcase of an internal combustion engine.

In a second aspect, the present invention provides a method of lubricating a spark-ignited or compression-ignited internal combustion engine, the method comprising lubricating the engine with a lubricating oil composition according to the first aspect.

In a third aspect, the present invention provides the use, in the lubrication of a spark-ignited or compression-ignited internal combustion engine, of a lubricating oil composition according to the first aspect, to inhibit wear in the engine.

In this specification, the following words and expressions, if and when used, have the meanings given below:

"active ingredient" or "(a.i.)" refers to additive material that is not diluent or solvent;

"comprising" or any cognate word specifies the presence of stated features, steps, or integers or components, but does not preclude the presence or addition of one or more other features, steps, integers, components or groups thereof. The expressions "consists of" or "consists essentially of" or cognates may be embraced within "comprises" or cognates, wherein "consists essentially of" permits inclusion of substances not materially affecting the characteristics of the composition to which it applies;

"hydrocarbyl" means a chemical group of a compound that contains hydrogen and carbon atoms and that is bonded to the remainder of the compound directly via a carbon atom. The group may contain one or more atoms other than carbon and hydrogen provided they do not affect the essentially hydrocarbyl nature of the group. Those skilled in the art will be aware of suitable groups (e.g., halo, especially chloro and fluoro, amino, alkoxyl, mercapto, alkylmercapto, nitro, nitroso, sulfoxy, etc.). Preferably, the group consists essentially of hydrogen and carbon atoms, unless specified otherwise. Preferably, the hydrocarbyl group comprises an aliphatic hydrocarbyl group. The term "hydrocarbyl" includes "alkyl", "alkenyl", "allyl" and "aryl" as defined herein;

"alkyl" means a group which is bonded to the remainder of the compound directly via a single carbon atom. Unless otherwise specified, alkyl groups may, when there are a sufficient number of carbon atoms, be linear (i.e. unbranched) or branched, be cyclic, acyclic or part cyclic/acyclic. Representative examples of alkyl groups include, but are not limited to, methyl, ethyl, n-propyl, iso-propyl, n-butyl, sec-butyl, iso-butyl, tert-butyl, n-pentyl, iso-pentyl, neo-pentyl, hexyl, heptyl, octyl, dimethyl hexyl, nonyl, decyl, undecyl, dodecyl, tridecyl, tetradecyl, pentadecyl, hexadecyl, heptadecyl, octadecyl, nonadecyl, icosyl and triacontyl;

"aryl" means an aromatic group, optionally substituted by one or more alkyl groups, halo, hydroxyl, alkoxy and amino groups, which is bonded to the remainder of the compound directly via a single carbon atom. Preferred aryl groups include phenyl and naphthyl groups and substituted derivatives thereof, especially phenyl and alkyl substituted derivatives thereof;

"alkenyl" means a group which includes at least one carbon to carbon double bond and is bonded to the remainder of the compound directly via a single carbon atom, and is otherwise defined as "alkyl";

"alkylene" means a bivalent saturated acyclic aliphatic radical which may be linear or branched. Representative examples of alkylene include ethylene, propylene, butylene, isobutylene, pentylene, hexylene, heptylene, octylene, nonylene, decylene, 1-methyl ethylene, 1-ethyl ethylene, 1-ethyl-2-methyl ethylene, 1,1-dimethyl ethylene and 1-ethyl propylene;

"halo" or "halogen" includes fluoro, chloro, bromo and iodo;

"oil-soluble" or "oil-dispersible", or cognate terms, used herein do not necessarily indicate that the compounds or additives are soluble, dissolvable, miscible, or are capable of being suspended in the oil in all proportions. These do mean, however, that they are, for example, soluble or stably dispersible in oil to an extent sufficient to exert their intended effect in the environment in which the oil is employed. Moreover, the additional incorporation of other additives may also permit incorporation of higher levels of a particular additive, if desired;

"ashless" in relation to an additive means the additive does not include a metal;

"ash-containing" in relation to an additive means the additive includes a metal;

"major amount" means more than 50 mass % of a composition expressed in respect of the stated component and in respect of the total mass of the composition, reckoned as active ingredient of the component;

"minor amount" means less than 50 mass % of a composition, expressed in respect of the stated additive and in respect of the total mass of the composition, reckoned as active ingredient of the additive;

"effective minor amount" in respect of an additive means an amount of such an additive in a lubricating oil composition so that the additive provides the desired technical effect;

"ppm" means parts per million by mass, based on the total mass of the lubricating oil composition;

"metal content" of the lubricating oil composition or of an additive component, for example molybdenum content or total metal content of the lubricating oil composition (i.e. the sum of all individual metal contents), is measured by ASTM D5185;

"TBN" in relation to an additive component or of a lubricating oil composition of the present invention, means total base number (mg KOH/g) as measured by ASTM D2896;

"$KV_{100}$" means kinematic viscosity at 100° C. as measured by ASTM D445;

"phosphorus content" is measured by ASTM D5185;

"sulfur content" is measured by ASTM D2622; and,

"sulfated ash content" is measured by ASTM D874.

All percentages reported are mass % on an active ingredient basis, i.e. without regard to carrier or diluent oil, unless otherwise stated.

Also, it will be understood that various components used, essential as well as optimal and customary, may react under conditions of formulation, storage or use and that the invention also provides the product obtainable or obtained as a result of any such reaction.

Further, it is understood that any upper and lower quantity, range and ratio limits set forth herein may be independently combined.

Also, it will be understood that the preferred features of each aspect of the present invention are regarded as preferred features of every other aspect of the present invention.

Metal-Free Pre-Ceramic Polymers

As used in the context of this invention, a pre-ceramic polymer is a polymer which can be converted into, or decomposes into a ceramic under heat treatment or pyrolysis, often under an applied pressure. The pre-ceramic polymers are metal-free. Examples of suitable pre-ceramic polymers are described in Colombo et al., in *J. Am. Ceram. Soc.*, 93 [7], 1805-1837 (2010).

In the field of polymer science, polymers composed of a small number of repeat units, for example 2 to 10 repeat units, are sometimes referred to as oligomers. For the sake of simplicity, in this specification, the term "pre-ceramic polymer" is used to refer to both pre-ceramic oligomers and pre-ceramic polymers.

Preferred metal-free pre-ceramic polymers are silicon-containing pre-ceramic polymers.

In preferred embodiments, the metal-free pre-ceramic polymer comprises a polysilazane, a polyborosilane, a polycarbosilane, a polyborosilazane, or a polysilylcarbodiimide. Mixtures of these materials are also suitable.

Preferably the pre-ceramic polymer contains a repeat unit of formula (I):

(I)

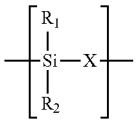

where X is NH, NR, $BR_3$ or $R_4$, or the pre-ceramic polymer contains a repeat unit of formula (II), (III) or (IV):

(II)

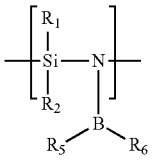

-continued (III)

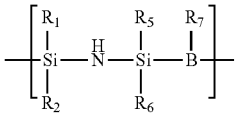

(IV)

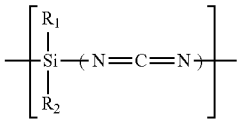

where R, $R_1$, $R_2$, $R_3$, $R_4$, $R_5$, $R_6$ and $R_7$ are independently hydrocarbyl groups containing 1 to 30 carbon atoms, preferably 1 to 18.

Preferably, R, $R_1$, $R_2$, $R_3$, $R_4$, $R_5$, $R_6$ and $R_7$ are independently linear or branched alkyl or alkenyl groups, or aryl groups containing 1 to 30 carbon atoms, preferably 1 to 18 carbon atoms. Examples of suitable groups include methyl, ethyl, propyl, butyl, propyl and longer n-alkyl homologs such as hexadecyl, heptadecyl and octadecyl and branched alkyl groups such as iso-propyl. Also suitable are the alkenyl homologs of the above groups, for example hexadecenyl, heptadecenyl and octadecenyl. Phenyl and non-aromatic cyclic groups are also suitable and these may be substituted or unsubstituted.

When X is NH or NR, the pre-ceramic polymer is a polysilazane, when X is $BR_3$ the pre-ceramic polymer is a polyborosilane and when X is $R_4$, the pre-ceramic polymer is a polycarbosilane.

Metal-free pre-ceramic polymers of formula (II) or formula (III) are polyborosilazanes.

Metal-free pre-ceramic polymers of formula (IV) are polysilylcarbodiimides.

The metal-free pre-ceramic polymers may consist only of units of formulae (I) to (IV) or they may include additional units or groups. For example, in an embodiment, the metal-free pre-ceramic polymer may be capped at one or both ends by a capping or chain-terminating group such as an amide group, an amine or polyamine, an ester, an ether, a thioether or a polymeric residue such as a polyalkylene glycol group or polythioether. Other suitable capping or chain-terminating groups will be known to those skilled in the art. These capping or chain-terminating groups may contain oxygen atoms but they will not contain any metal atoms.

In an embodiment of a polymer having a capping or chain-terminating group, the polymer has the structure:

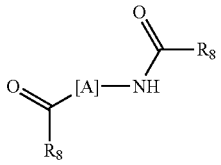

where [A] represents a structural moiety comprised of repeat units of formulae (I), (II), (III) or (IV) as described above, and where $R_8$ is, or each $R_8$ is independently, a group as defined for R to $R_7$ above.

In one embodiment, the repeat units of formulae (I) to (IV) form a closed ring structure.

The number of repeat units of formulae (I) to (IV) in the metal-free pre-ceramic polymer is suitably in the range from 2 to 100, preferably from 2 to 50, more preferably from 2 to 20, for example from 2 to 10 or from 2 to 5.

In an embodiment at least one of R, $R_1$, $R_2$, $R_3$, $R_5$, $R_6$ and $R_7$ contains at least 3, preferably at least 8, more preferably at least 12 carbon atoms, and/or any capping or chain-terminating group contains such a group, for example $R_8$.

In an embodiment of a metal-free pre-ceramic polymer having repeat units of formula (I), the polymer comprises a compound of structure (VII):

(VII)

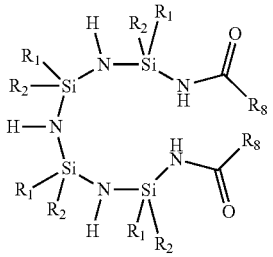

where $R_1$, $R_2$ and $R_8$ are as defined above, provided that at least one of $R_1$, $R_2$ and $R_8$ contains at least 3, preferably at least 8 carbon atoms.

In an alternative embodiment, the metal-free pre-ceramic polymer comprises a compound of structure (VII) but where the nitrogen atoms which are between two silicon atoms carry a group R, as defined above, rather than hydrogen. Such a structure results for example when the polymer contains repeat units of formula (I) and where X is NR. In this embodiment, at least one of R, $R_1$, $R_2$ and $R_8$ contains at least 3, preferably at least 8 carbon atoms.

In a further embodiment of a metal-free pre-ceramic polymer having repeat units of formula (I), the polymer comprises a compound of structure (VIII):

(VIII)

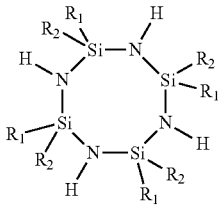

where $R_1$ and $R_2$ are as defined above, provided that at least one of $R_1$ and $R_2$ contains at least 3, preferably at least 8 carbon atoms.

In an alternative embodiment, the metal-free pre-ceramic polymer comprises a compound of structure (VIII) but where the nitrogen atoms carry a group R, as defined above, rather than hydrogen. Such a structure results for example when the polymer contains repeat units of formula (I) and where X is NR. In this embodiment, at least one of R, $R_1$ and $R_2$ contains at least 3, preferably at least 8 carbon atoms.

In a yet further embodiment, the pre-ceramic polymer comprises a mixture of compounds of structures (VII) and (VIII).

In one preferred embodiment, the metal-free pre-ceramic polymer comprises a compound of structure (VII) where $R_1$ and $R_2$ are iso-propyl and $R_8$ is heptadecenyl.

In another preferred embodiment, the metal-free pre-ceramic polymer comprises a compound of structure (VII) where $R_1$ and $R_2$ are iso-propyl and $R_8$ is n-propyl.

In another preferred embodiment, the metal-free pre-ceramic polymer comprises a compound of structure (VII) where $R_1$ is methyl, $R_2$ is octadecyl and $R_8$ is heptadecenyl.

In another preferred embodiment, the metal-free pre-ceramic polymer comprises a compound of structure (VIII) where $R_1$ is methyl and $R_2$ is octadecyl.

Methods for the synthesis of metal-free pre-ceramic polymers useful in the present invention will be known to those skilled in the art. As described in Colombo et al., in *J. Am. Ceram. Soc.,* 93 [7], 1805-1837 (2010), a convenient synthetic route to silicon-containing pre-ceramic polymers uses a chlorosilane as a starting material but hydrosilanes, vinylsilanes and alkenylsilanes may also be employed. Polymerisation of these staring materials through elimination, substitution or addition reactions affords the pre-ceramic polymers.

In a fourth aspect, the present invention provides a lubricating oil composition comprising a major amount of an oil of lubricating viscosity and a minor amount of a metal-free pre-ceramic polymer, wherein the pre-ceramic polymer comprises a plurality of repeat units which do not contain oxygen, wherein the pre-ceramic polymer comprises the product of the reaction between (i) a dihalodihydrocarbylsilane, a dihalohydrocarbylsilane or any mixture thereof and (ii) ammonia, a primary amine or a mixture thereof, and wherein the lubricating oil composition further comprises one or more co-additives.

Preferably (i) is a dichlorodialkylsilane, a dichloroalkylsilane or any mixture thereof.

Preferably (ii) is ammonia.

In an embodiment of the fourth aspect, the metal-free pre-ceramic polymer comprises the product of the reaction of (i) and (ii) further reacted with (iii) an amide, an amine, an ester, an ether or a polyalkylene glycol. Preferably (iii) is an amide.

In an embodiment, the metal-free pre-ceramic polymer comprises a mixture of the product of the reaction of (i) and (ii) and the product of the reaction of (i) and (ii), further reacted with (iii).

All preferred features of the other aspects of the invention as described herein apply equally to the fourth aspect.

Dependent on composition and the method of manufacture, the metal-free pre-ceramic polymers may be liquids or solids which may be oil-soluble or oil-dispersible. The physical form of the metal-free pre-ceramic polymers is not critical in the context of this invention. The only requirement is that the metal-free pre-ceramic polymers are either in a form, or are capable of being provided in a form, which permits their incorporation into the lubricating oil composition.

The metal-free pre-ceramic polymer may be present in the lubricating oil composition in any effective minor amount. Preferably, the metal-free pre-ceramic polymer is present in the lubricating oil composition in an amount of between 0.001 and 10 percent by weight, based on the weight of the composition, more preferably between 0.01 and 5 percent by weight, for example between 0.01 and 10 percent by weight.

The lubricating oil composition also comprises one or more co-additives. These co-additives are different from the metal-free pre-ceramic polymer. Suitable co-additives are described in further detail below and include antiwear additives, oil-soluble or oil-dispersible molybdenum-containing compounds, metal-containing detergents, ashless dispersants, ashless friction modifiers, viscosity modifiers, anti-oxidants, rust inhibitors, copper and lead bearing corrosion inhibitors, demulsifiers and pour point depressants. As is known in the art, some additives can provide a multiplicity of effects.

In an embodiment, the lubricating oil composition contains, in addition to the metal-free pre-ceramic polymer, co-additives including at least an ashless dispersant, a metal-containing detergent, an oil-soluble or oil-dispersible molybdenum-containing compound, an anti-oxidant, a pour point depressant and a viscosity modifier. In some embodiments the lubricating oil composition further contains an antiwear additive as a co-additive. In other embodiments, the lubricating oil composition does not contain any antiwear additives other than the metal-free pre-ceramic polymer.

As is known in the art, co-additives are present in lubricating oil compositions in minor amounts. Typically each co-additive will be present in an amount of between 0.001 and 30% by weight, based on the weight of the composition, more typically, between 0.001 and 10% by weight.

The Lubricant

The lubricating oil composition comprises an oil of lubricating viscosity.

An oil of lubricating viscosity (sometimes referred to as "base stock" or "base oil") is the primary liquid constituent of a lubricating oil composition, into which additives and possibly other oils are blended, for example to produce a final lubricating oil composition. A base oil is useful for making concentrates as well as for making lubricating oil compositions therefrom, and may be selected from natural (vegetable, animal or mineral) and synthetic lubricating oils and mixtures thereof.

The base stock groups are defined in the American Petroleum Institute (API) publication "Engine Oil Licensing and Certification System", Industry Services Department, Fourteenth Edition, December 1996, Addendum 1, December 1998. Typically, the base stock will have a viscosity preferably of 3-12, more preferably 4-10, most preferably 4.5-8, $mm^2/s$ (cSt) at 100° C.

Definitions for the base stocks and base oils in this invention are the same as those found in the American Petroleum Institute (API) publication "Engine Oil Licensing and Certification System", Industry Services Department, Fourteenth Edition, December 1996, Addendum 1, December 1998. Said publication categorizes base stocks as follows:

a) Group I base stocks contain less than 90 percent saturates and/or greater than 0.03 percent sulphur and have a viscosity index greater than or equal to 80 and less than 120 using the test methods specified in Table E-1.

b) Group II base stocks contain greater than or equal to 90 percent saturates and less than or equal to 0.03 percent sulphur and have a viscosity index greater than or equal to 80 and less than 120 using the test methods specified in Table E-1.

c) Group III base stocks contain greater than or equal to 90 percent saturates and less than or equal to 0.03 percent sulphur and have a viscosity index greater than or equal to 120 using the test methods specified in Table E-1.

d) Group IV base stocks are polyalphaolefins (PAO).

e) Group V base stocks include all other base stocks not included in Group I, II, III, or IV.

TABLE E-1

| Analytical Methods for Base Stock | |
|---|---|
| Property | Test Method |
| Saturates | ASTM D 2007 |
| Viscosity Index | ASTM D 2270 |
| Sulphur | ASTM D 2622 |
| | ASTM D 4294 |
| | ASTM D 4927 |
| | ASTM D 3120 |

Other oils of lubricating viscosity which may be included in the lubricating oil composition are detailed as follows:

Natural oils include animal and vegetable oils (e.g. castor and lard oil), liquid petroleum oils and hydrorefined, solvent-treated mineral lubricating oils of the paraffinic, naphthenic and mixed paraffinic-naphthenic types. Oils of lubricating viscosity derived from coal or shale are also useful base oils.

Synthetic lubricating oils include hydrocarbon oils such as polymerized and interpolymerized olefins (e.g. polybutylenes, polypropylenes, propylene-isobutylene copolymers, chlorinated polybutylenes, poly(1-hexenes), poly(1-octenes), poly(1-decenes)); alkylbenzenes (e.g. dodecylbenzenes, tetradecylbenzenes, dinonylbenzenes, di(2-ethylhexyl)benzenes); polyphenols (e.g. biphenyls, terphenyls, alkylated polyphenols); and alkylated diphenyl ethers and alkylated diphenyl sulfides and the derivatives, analogues and homologues thereof.

Another suitable class of synthetic lubricating oils comprises the esters of dicarboxylic acids (e.g. phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g. butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols, and polyol ethers such as neopentyl glycol, trimethylolpropane, pentaerythritol, dipentaerythritol and tripentaerythritol.

Unrefined, refined and re-refined oils can be used in the compositions of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be unrefined oil. Refined oils are similar to the unrefined oils except they have been further treated in one or more purification steps to improve one or more properties. Many such purification techniques, such as distillation, solvent extraction, acid or base extraction, filtration and percolation are known to those skilled in the art. Re-refined oils are obtained by processes similar to those used to obtain refined oils applied to refined oils which have been already used in service. Such re-refined oils are also known as reclaimed or reprocessed oils and often are additionally processed by techniques for approval of spent additive and oil breakdown products.

Other examples of base oil are gas-to-liquid ("GTL") base oils, i.e. the base oil may be an oil derived from Fischer-Tropsch synthesised hydrocarbons made from synthesis gas containing $H_2$ and CO using a Fischer-Tropsch catalyst. These hydrocarbons typically require further processing in order to be useful as a base oil. For example, they may, by methods known in the art, be hydroisomerized; hydrocracked and hydroisomerized; dewaxed; or hydroisomerized and dewaxed.

The composition of the base oil will depend upon the particular application of the lubricating oil composition and the oil formulator will chose the base oil to achieve desired performance characteristics at reasonable cost.

Preferably, the volatility of the oil of lubricating viscosity or oil blend, as measured by the NOACK test (ASTM D5800), is less than or equal to 20%, preferably less than or equal to 16%, preferably less than or equal to 12%, more preferably less than or equal to 10%. Preferably, the viscosity index (VI) of the oil of lubricating viscosity is at least 95, preferably at least 110, more preferably at least 120, even more preferably at least 125, most preferably from about 130 to 140.

The oil of lubricating viscosity is provided in a major amount, in combination with a minor amount of one or more pre-ceramic polymers, as defined herein and, if necessary, one or more co-additives, such as described hereinafter. This preparation may be accomplished by adding the additives directly to the oil or by adding them in the form of a concentrate thereof to disperse or dissolve the additive. Additives may be added to the oil by any method known to those skilled in the art, either before, at the same time as, or after addition of other additives.

Preferably, the lubricating oil composition is a multigrade oil identified by the viscometric descriptor SAE 20W-X, SAE 15W-X, SAE 10W-X, SAE 5W-X or SAE 0W-X, where X represents any one of 8, 12, 16, 20, 30, 40 and 50; the characteristics of the different viscometric grades can be found in the SAE J300 classification. In an embodiment of each aspect of the invention, independently of the other embodiments, the lubricating oil composition is in the form of an SAE 10W-X, SAE 5W-X or SAE 0W-X where those oils can be blended according to the SAE J300 classification, preferably in the form of a SAE 5W-X or SAE 0W-X, wherein X represents any one of 8, 12, 16, 20, 30, 40 and 50. Preferably X is 8, 12, 16 or 20.

In a particularly preferred embodiment of the present invention, the lubricating oil composition comprises a major proportion of an oil of lubricating viscosity chosen from API Groups I, II, III, IV and V, or any mixture or blend thereof, and a minor proportion of a pre-ceramic polymer as defined herein.

Preferably, the oil of lubricating viscosity is present in an amount of greater than 55 mass %, more preferably greater than 60 mass %, even more preferably greater than 65 mass %, based on the total mass of the lubricant composition. Preferably, the oil of lubricating viscosity is present in an amount of less than 98 mass %, more preferably less than 95 mass %, even more preferably less than 90 mass %, based on the total mass of the lubricant composition.

Co-Additives

Antiwear Additives

The pre-ceramic polymers provide the lubricating oil composition with antiwear properties such that additional antiwear additives may be unnecessary to achieve satisfactory wear performance. However if desired, the lubricating oil composition may contain further antiwear additives. Among these are phosphorus-containing antiwear additives in the form of dihydrocarbyl dithiophosphate metal salts.

Dihydrocarbyl dithiophosphate metal salts may be prepared in accordance with known techniques by first forming a dihydrocarbyl dithiophosphoric acid (DDPA), usually by reaction of one or more alcohols or a phenol with $P_2S_5$ and then neutralizing the formed DDPA with a metal compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the metal salt, any basic or neutral metal compound could be used but the oxides, hydroxides and carbonates are most generally employed. Commercial additives frequently contain an excess of metal due to the use of an excess of the basic metal compound in the neutralization reaction.

The preferred zinc dihydrocarbyl dithiophosphates (ZDDP) are oil-soluble salts of dihydrocarbyl dithiophosphoric acids and may be represented by the following formula:

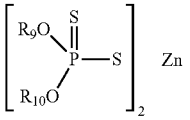

wherein $R_9$ and $R_{10}$ may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as $R_9$ and $R_{10}$ groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. $R_9$ and $R_{10}$) in the dithiophosphoric acid will generally be about 5 or greater. The zinc dihydrocarbyl dithiophosphate can therefore comprise zinc dialkyl dithiophosphates.

In a preferred embodiment where ZDDP is present, the lubricating oil composition contains ZDDP in an amount sufficient to provide no greater than 800 ppm, preferably no greater than 600 ppm, more preferably no greater than 400 ppm, 300 ppm, 200 ppm or 100 ppm by mass of phosphorous to the lubricating oil composition, based upon the total mass of the lubricating oil composition, and as measured in accordance with ASTM D5185. These amounts of phosphorus are representative of reduced or low phosphorus-content lubricating oil compositions and here the metal-free pre-ceramic polymer can acts as a partial replacement for ZDDP providing wear protection substantially equivalent to or greater than similar lubricating oil compositions containing higher amounts of phosphorus.

In another embodiment, ZDDP may be added to the lubricating oil compositions in any suitable greater amount. For example, the lubricating oil composition may contain ZDDP in an amount sufficient to provide from greater than 800 ppm to 1200 ppm by mass of phosphorous to the lubricating oil composition, based upon the total mass of the lubricating oil composition, and as measured in accordance with ASTM D5185. These amounts of phosphorus are representative of common, high phosphorus-content lubricating oil compositions and here the metal-free pre-ceramic polymer can provide additional wear protection over and above that contributed by the ZDDP.

In another embodiment, the lubricating oil composition of the present invention does not contain a zinc dihydrocarbyl dithiophosphate (ZDDP). In these lubricating oil compositions, the metal-free pre-ceramic polymer is used as a complete replacement for ZDDP.

Further or alternative antiwear additives will be known to those skilled in the art. A non-exhaustive list includes 1,2,3-triazoles, benzotriazoles, sulphurised fatty acid esters and dithiocarbamate derivatives such as zinc dithiocarbamates.

Oil-Soluble or Oil-Dispersible Molybdenum-Containing Additives

For the lubricating compositions of the present invention, any suitable oil-soluble or oil-dispersible molybdenum compound having friction modifying properties may be employed. Preferably, the oil-soluble or oil-dispersible molybdenum compound is an oil-soluble or oil-dispersible organo-molybdenum compound. As examples of such organo-molybdenum compounds, there may be mentioned molybdenum dithiocarbamates, molybdenum dithiophosphates, molybdenum dithiophosphinates, molybdenum xanthates, molybdenum thioxanthates, molybdenum sulfides, and the like, and mixtures thereof. Particularly preferred are molybdenum dithiocarbamates, molybdenum dialkyldithiophosphates, molybdenum alkyl xanthates and molybdenum alkylthioxanthates. An especially preferred organo-molybdenum compound is a molybdenum dithiocarbamate. In an embodiment of the present invention any oil-soluble or oil-dispersible molybdenum compound consists of either a molybdenum dithiocarbamate or a molybdenum dithiophosphate or a mixture thereof, as the sole source of molybdenum atoms in the composition. In an alternative embodiment of the present invention the oil-soluble or oil-dispersible molybdenum compound consists of a molybdenum dithiocarbamate, as the sole source of molybdenum atoms in the lubricating oil composition.

The molybdenum compound may be mono-, di-, tri- or tetra-nuclear. Di-nuclear and tri-nuclear molybdenum compounds are preferred.

Suitable dinuclear or dimeric molybdenum dialkyldithiocarbamate are represented by the following formula:

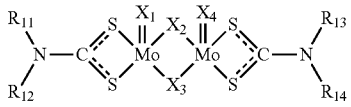

where $R_{11}$ to $R_{14}$ independently denote a straight chain, branched chain or aromatic hydrocarbyl group having 1 to 24 carbon atoms; and $X_1$ through $X_4$ independently denote an oxygen atom or a sulfur atom. The four hydrocarbyl groups, $R_{11}$ to $R_{14}$, may be identical or different from one another.

Other molybdenum compounds useful in the compositions of this invention are organo-molybdenum compounds of the formulae $Mo(R_{15}OCS2)_4$ and $Mo(R_{15}SCS_2)_4$, wherein $R_{15}$ is an organo group selected from the group consisting of alkyl, aryl, aralkyl and alkoxyalkyl, generally of from 1 to 30 carbon atoms, and preferably 2 to 12 carbon atoms and most preferably alkyl of 2 to 12 carbon atoms. Especially preferred are the dialkyldithiocarbamates of molybdenum.

Suitable tri-nuclear organo-molybdenum compounds include those of the formula $Mo_3S_kL_nQ_z$ and mixtures thereof wherein L are independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms should be present among all the ligands' organo groups, such as at least 25, at least 30, or at least 35 carbon atoms.

The ligands are independently selected from the group of:

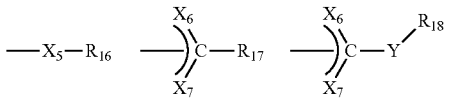

and mixtures thereof, wherein $X_5$, $X_6$, $X_7$, and Y are independently selected from the group of oxygen and sulfur, and wherein $R_{16}$, $R_{17}$, and $R_{18}$ are independently selected from hydrogen and organo groups that may be the same or different. Preferably, the organo groups are hydrocarbyl groups such as alkyl (e.g., in which the carbon atom attached to the remainder of the ligand is primary or secondary), aryl, substituted aryl and ether groups. More preferably, each ligand has the same hydrocarbyl group.

Importantly, the organo groups of the ligands have a sufficient number of carbon atoms to render the compound soluble or dispersible in the oil. For example, the number of carbon atoms in each group will generally range between about 1 to about 100, preferably from about 1 to about 30, and more preferably between about 4 to about 20. Preferred ligands include dialkyldithiophosphate, alkylxanthate, and dialkyldithiocarbamate, and of these dialkyldithiocarbamate is more preferred. Organic ligands containing two or more of the above functionalities are also capable of serving as ligands and binding to one or more of the cores. Those skilled in the art will realize that formation of the compounds of the present invention requires selection of ligands having the appropriate charge to balance the core's charge.

Compounds having the formula $Mo_3S_kL_nQ_z$ have cationic cores surrounded by anionic ligands and are represented by structures such as

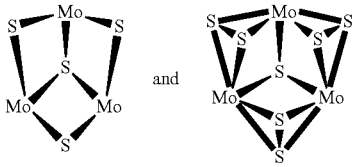

and have net charges of +4. Consequently, in order to solubilize these cores the total charge among all the ligands must be −4. Four mono-anionic ligands are preferred. Without wishing to be bound by any theory, it is believed that two or more tri-nuclear cores may be bound or interconnected by means of one or more ligands and the ligands may be multidentate. This includes the case of a multidentate ligand having multiple connections to a single core. Oxygen and/or selenium may be substituted for sulfur in the core(s).

Oil-soluble or oil-dispersible tri-nuclear molybdenum compounds can be prepared by reacting in the appropriate liquid(s)/solvent(s) a molybdenum source such as $(NH_4)_2Mo_3S_{13}.n(H_2O)$, where n varies between 0 and 2 and includes non-stoichiometric values, with a suitable ligand source such as a tetralkylthiuram disulfide. Other oil-soluble or dispersible tri-nuclear molybdenum compounds can be formed during a reaction in the appropriate solvent(s) of a molybdenum source such as of $(NH_4)_2Mo_3S_{13}.n(H_2O)$, a ligand source such as tetralkylthiuram disulfide, dialkyldithiocarbamate, or dialkyldithiophosphate, and a sulfur abstracting agent such as cyanide ions, sulfite ions, or substituted phosphines. Alternatively, a tri-nuclear molybdenum-sulfur halide salt such as $[M']_2[Mo_3S_7A_6]$, where M' is a counter ion, and A is a halogen such as Cl, Br, or I, may be reacted with a ligand source such as a dialkyldithiocarbamate or dialkyldithiophosphate in the appropriate liquid(s)/solvent(s) to form an oil-soluble or dispersible trinuclear molybdenum compound. The appropriate liquid/solvent may be, for example, aqueous or organic.

A compound's oil solubility or dispersibility may be influenced by the number of carbon atoms in the ligand's organo groups. Preferably, at least 21 total carbon atoms should be present among all the ligands' organo groups. Preferably, the ligand source chosen has a sufficient number of carbon atoms in its organo groups to render the compound soluble or dispersible in the lubricating oil composition.

Other molybdenum compounds include acidic molybdenum compounds. These compounds will react with a basic nitrogen compound as measured by ASTM test D-664 or D-2896 titration procedure and are typically hexavalent. Included are molybdic acid, ammonium molybdate, sodium molybdate, potassium molybdate, and other alkaline metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds. Alternatively, the compositions of the present invention can be provided with molybdenum by molybdenum/sulfur complexes of basic nitrogen compounds as described, for example, in U.S. Pat. Nos. 4,263,152; 4,285,822; 4,283,295; 4,272,387; 4,265,773; 4,261,843; 4,259,195 and 4,259,194; and WO 94/06897.

Lubricating oil compositions according to the present invention may contain the molybdenum compound in an amount providing the composition with from 500 to 1500 ppm, preferably from 600-1200 ppm, for example from 700 to 1000 ppm of molybdenum (ASTM D5185).

Metal-Containing Detergents

Metal-containing detergents function both as detergents to reduce or remove deposits and as acid neutralizers or rust inhibitors, thereby reducing wear and corrosion and extending engine life. Detergents generally comprise a polar head with a long hydrophobic tail, with the polar head comprising a metal salt of an acidic organic compound. The salts may contain a substantially stoichiometric amount of the metal in which case they are usually described as normal or neutral salts, and would typically have a total base number or TBN (as can be measured by ASTM D2896) of from 0 to 80 mg KOH/g. A large amount of a metal base may be incorporated by reacting excess metal compound (e.g., an oxide or hydroxide) with an acidic gas (e.g., carbon dioxide). The resulting overbased detergent comprises neutralized detergent as the outer layer of a metal base (e.g. carbonate) micelle. Such overbased detergents may have a TBN of 150 mg KOH/g or greater, and typically will have a TBN of from 250 to 450 mg KOH/g or more.

Suitable metal-containing detergents are known in the art and include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., sodium, potassium, lithium, calcium, and magnesium. Furthermore, the additional detergent additive may comprise hybrid detergent comprising any combination of sodium, potassium, lithium, calcium, or magnesium salts of sulfonates, phenates, sulfurized phenates, thiophosphonates, salicylates, and naphthenates.

Sulfonate detergents may be prepared from sulfonic acids which are typically obtained by the sulfonation of alkyl substituted aromatic hydrocarbons such as those obtained from the fractionation of petroleum or by the alkylation of aromatic hydrocarbons. Examples include those obtained by alkylating benzene, toluene, xylene, naphthalene, diphenyl or their halogen derivatives such as chlorobenzene, chlorotoluene and chloronaphthalene. Alkylation may be carried out in the presence of a catalyst with alkylating agents having from about 3 to more than 70 carbon atoms. Alkaryl sulfonates usually contain from about 9 to about 80 or more carbon atoms, preferably from about 16 to about 60 carbon atoms per alkyl substituted aromatic moiety. The oil soluble sulfonates or alkaryl sulfonic acids may be neutralized with oxides, hydroxides, alkoxides, carbonates, carboxylate, sulfides, hydrosulfides, nitrates, borates and ethers of the metal. The amount of metal compound is chosen having regard to the desired TBN of the final product but typically ranges from about 100 to 220 mass % (preferably at least 125 mass %) of that stoichiometrically required.

Metal salts of phenols and sulfurized phenols may be prepared by reaction of the phenol with an appropriate metal compound such as an oxide or hydroxide and neutral or overbased products may be obtained by methods well known in the art. Sulfurized phenols may be prepared by reacting a phenol with sulfur or a sulfur containing compound such as hydrogen sulfide, sulfur monohalide or sulfur dihalide, to form products which are generally mixtures of compounds in which two or more phenols are bridged by sulfur containing bridges.

Carboxylate detergents, e.g., salicylates, can be prepared by reacting an aromatic carboxylic acid with an appropriate metal compound such as an oxide or hydroxide and neutral or overbased products may be obtained by methods well known in the art. The aromatic moiety of the aromatic carboxylic acid can contain heteroatoms, such as nitrogen and oxygen. Preferably, the moiety contains only carbon atoms; more preferably the moiety contains six or more carbon atoms; for example benzene is a preferred moiety. The aromatic carboxylic acid may contain one or more aromatic moieties, such as one or more benzene rings, either fused or connected via alkylene bridges.

Preferred substituents in oil-soluble salicylic acids are alkyl substituents. In alkyl-substituted salicylic acids, the alkyl groups advantageously contain 5 to 100, preferably 9 to 30, especially 14 to 20, carbon atoms. Where there is more than one alkyl group, the average number of carbon atoms in all of the alkyl groups is preferably at least 9 to ensure adequate oil solubility.

Ashless Dispersants

These include compounds having an oil-soluble polymeric hydrocarbon backbone having functional groups that are capable of associating with particles to be dispersed. Typically, the dispersants comprise amine, alcohol, amide, or ester polar moieties attached to a polymer backbone often via a bridging group. Examples include oil-soluble salts, esters, amino-esters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and a polyalkylene polyamine. As is known in the art, ashless dispersants may be borated or non-borated.

Ashless Friction Modifiers

Nitrogen-free organic friction modifiers may be useful in the compositions of the present invention and are generally known. Examples include esters formed by reacting carboxylic acids and anhydrides with alkanols. Other useful friction modifiers include a polar terminal group (e.g. carboxyl or hydroxyl) covalently bonded to an oleophilic hydrocarbon chain, and esters of carboxylic acids and anhydrides with alkanols as described in U.S. Pat. No. 4,702,850. Further examples of conventional organic friction modifiers are described by M. Belzer in the "Journal of Tribology" (1992), Vol. 114, pp. 675-682 and M. Belzer and S. Jahanmir in "Lubrication Science" (1988), Vol. 1, pp. 3-26.

Preferred organic ashless nitrogen-free friction modifiers are esters or ester-based; a particularly preferred organic ashless nitrogen-free friction modifier is glycerol monooleate (GMO).

Ashless aminic or amine-based friction modifiers may also be used and include oil-soluble alkoxylated mono- and di-amines, which improve boundary layer lubrication. One common class of nitrogen-containing ashless friction modifier are ethoxylated alkyl amines. These may be in the form of an adduct or reaction product with a boron compound such as a boric oxide, boron halide, metaborate, boric acid or a mono-, di- or tri-alkyl borate. Another metal free, nitrogen-containing friction modifier is an ester formed as the reaction product of (i) a tertiary amine having aliphatic hydrocarbyl, preferably alkyl, groups having 1 to 6 carbon atoms, at least one of such hydrocarbyl groups having a hydroxyl group, with (ii) a saturated or unsaturated fatty acid having 10 to 30 carbon atoms. Preferably, at least one of the aliphatic hydrocarbyl groups is an alkyl group. Preferably, the tertiary amine will have at least one hydroxyalkyl group having 2 to 4 carbon atoms. The ester may be a mono-, di- or tri-ester or a mixture thereof, depending on how many hydroxyl groups are available for esterification with the acyl group of the fatty acid. A preferred compound comprises a mixture of esters formed as the reaction product of (i) a tertiary hydroxy amine having $C_2$-$C_4$ hydroxy alkyl groups with (ii) a saturated or unsaturated fatty acid having 10 to 30 carbon atoms, with the mixture of esters so formed comprising at least 30-60 mass %, preferably 45-55 mass % diester, such as 50 mass % diester, 10-40 mass %, preferably 20-30 mass % monoester, e.g. 25 mass % monoester, and 10-40 mass %, preferably 20-30 mass % triester, such as 25 mass % triester. Suitably, the ester is a mono-, di- or tri-carboxylic acid ester of triethanolamine and mixtures thereof.

Typically, the total amount of ashless friction modifier in a lubricating oil composition according to the present invention does not exceed 5 mass %, based on the total mass of the composition and preferably does not exceed 2 mass % and more preferably does not exceed 0.5 mass %.

Viscosity Modifiers (VM)

Viscosity modifiers function to impart high and low temperature operability to a lubricating oil. The VM used may have that sole function, or it may be multifunctional. Multifunctional viscosity modifiers that also function as dispersants are also known. Suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter-polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene.

Anti-Oxidants

These are sometimes referred to as oxidation inhibitors and increase the resistance of the composition to oxidation. Anti-oxidants are thought to work by combining with and modifying peroxides to render them harmless, by decomposing peroxides, or by rendering oxidation catalysts inert. Oxidative deterioration can be evidenced by sludge in the lubricant, varnish-like deposits on the metal surfaces, and by viscosity growth.

Examples of suitable antioxidants are copper-containing antioxidants, sulfur-containing antioxidants, aromatic amine-containing antioxidants, hindered phenolic antioxidants, dithiophosphates derivatives, and metal thiocarbamates. Preferred anti-oxidants are aromatic amine-containing antioxidants, hindered phenolic antioxidants and mixtures thereof. In a preferred embodiment, an antioxidant is present in a lubricating oil composition of the present invention.

Rust Inhibitors

These include nonionic polyoxyalkylene polyols and esters thereof, polyoxyalkylene phenols, and anionic alkyl sulfonic acids.

Copper and Lead Bearing Corrosion Inhibitors

Suitable compounds are thiadiazole polysulfides containing from 5 to 50 carbon atoms, their derivatives and polymers thereof. Derivatives of 1,3,4 thiadiazoles such as those described in U.S. Pat. Nos. 2,719,125; 2,719,126; and 3,087,932; are typical. Other similar materials are described in U.S. Pat. Nos. 3,821,236; 3,904,537; 4,097,387; 4,107,059; 4,136,043; 4,188,299; and 4,193,882. Other examples include thio- and polythio-sulfenamides of thiadiazoles such as those described in UK Patent Specification No. 1,560,830. Benzotriazoles derivatives also fall within this class of additives.

Demulsifiers

A preferred demulsifying component is described in EP 330522. It is obtained by reacting an alkylene oxide with an adduct obtained by reacting a bis-epoxide with a polyhydric alcohol.

Pour Mint Depressants

These materials, otherwise known as lube oil flow improvers, lower the minimum temperature at which the fluid will flow or can be poured. Such additives are well known. Typical examples are $C_8$ to $C_{18}$ dialkyl fumarate/vinyl acetate copolymers, polyalkylmethacrylates and the like.

The invention will now be described by way of non-limiting example only.

EXAMPLE SYNTHESIS OF POLYSILAZANE PRE-CERAMIC POLYMERS

Step 1: A 500 ml multi-necked, round-bottomed flask was fitted with a solid $CO_2$-cooled cold-finger condenser having a nitrogen inlet, a pressure-equalising dropping funnel, a thermal probe and a magnetic stirrer. The inlet/outlet of the condenser was connected to a three-way tap to allow nitrogen inlet and also headspace gas outlet to a scrubber solution (HCl, 2M) contained in a 1 litre beaker. A solution of ammonia in 1,4-dioxane (0.5M, 200 ml) was charged to the flask and the flask was placed in a cold bath (ca. 0° C.) and the solution stirred. Triethylamine (0.2 mol, 20.2 g) was then added to the flask using a syringe. The dropping funnel was then charged with anhydrous THF (100 ml) together with di-isopropyldichlorosilane (0.1 mol, 12.9 g) and the resulting solution added dropwise to the ammonia solution in the flask. The rate of addition was controlled so as to maintain at most a steady reflux of ammonia from the cold-finger and taking care to limit the rate of temperature rise to no more than 5° C. per minute. The reaction proceeded with the precipitation of ammonium chloride. Once all of the di-isopropyldichlorosilane solution had been added to the flask and the precipitation of ammonium chloride had stopped, the solution was cooled to below −33° C. with stirring to permit the removal of the cold-finger. The flask was then fitted with a stopper and allowed to warm to room temperature while venting any excess ammonia to the scrubber solution.

Step 2: Oleamide (0.05 mol, 14.07 g) dissolved in THF (100 ml) was then added dropwise to the solution obtained from Step 1. This reaction produced a solid by-product which was separated from the solution by filtration. The resulting filtrate was distilled to remove the solvent and the final liquid product was dried under vacuum for several hours.

The above synthesis is represented in the following scheme:

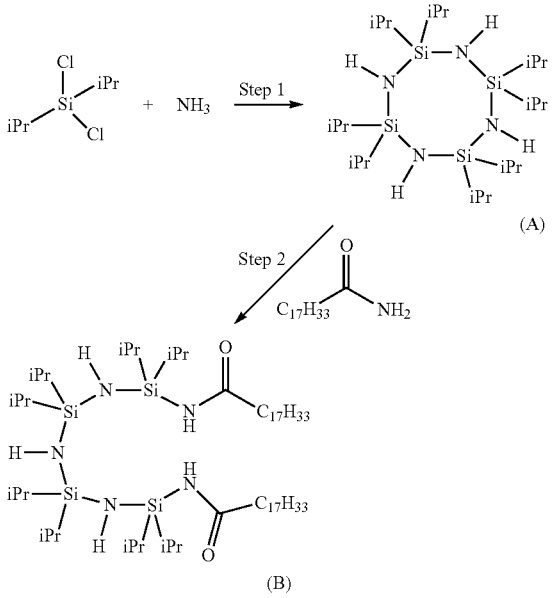

The polymer (B) produced from the above synthesis is labelled as Polymer P2 in the table below. Variation in groups $R_1$ and $R_2$ to produce analogous compounds was achieved by substituting the dialkyldichlorosilane starting material in Step 1 above (di-isopropyldichlorosilane in the case of P2) for a differently substituted compound (dichloro(methyl)(octadecyl)silane in the case of P3). Variation in group $R_8$ was achieved by using a different amide in Step 2 (e.g. butyramide instead of oleamide). Polymer P1 was made using the same reactants as P3 but by omitting Step 2 of the process (product (A) in the scheme above). As will be appreciated, primary amines can be used in place of ammonia to provide analogous polymers where the nitrogen atoms (excepting those of the amide groups) carry alkyl groups rather than hydrogen atoms.

Four silicon-containing, metal-free pre-ceramic polymers were prepared using the synthesis outlined above, conforming to structures (VII) and (VIII) described herein. They are detailed in the table below:

| Polymer | Structure type | Group $R_1$ | Group $R_2$ | Group $R_8$ derived from |
|---|---|---|---|---|
| P1 | (VIII) | methyl | $C_{18}$ - alkyl | n/a |
| P2 | (VII) | iso-propyl | iso-propyl | oleamide |
| P3 | (VII) | methyl | $C_{18}$ - alkyl | oleamide |
| P4 | (VII) | iso-propyl | iso-propyl | butyramide |

Six lubricating oils were formulated using an API Group III base stock. Details are shown in the table below. In addition to the anti-wear compounds listed in the table, all six lubricating oils contained similar amounts of an ashless dispersant, metal-containing detergents, a molybdenum-based friction modifier, anti-oxidants, a pour point depressant, a viscosity modifier and an anti-foaming component, all of the types and in amounts typically found in passenger car crankcase lubricating oils.

| Oil | Anti-wear compound/amount |
|---|---|
| 1 | none |
| 2 | ZDDP/to provide 800 ppm of phosphorus to the oil |
| 3 | P1/1 wt. % |
| 4 | P2/1 wt. % |
| 5 | P3/1 wt. % |
| 6 | P4/1 wt. % |

Oils 1 and 2 were comparative examples and Oils 3, 4, 5 and 6 represent examples according to the present invention. None of Oils 3, 4, 5 and 6 contained any phosphorus.

Each oil was tested using a 'Mini Traction Machine MTM' obtainable from PCS Instruments, London. In this test, a steel ball is loaded against the face of a steel disc and both the ball and the disc are driven independently to create a mixed rolling/sliding contact. Tests were run for a duration of 2 hours at an oil temperature of 100° C. The load between the ball and the disc was set at 50N giving a maximum contact pressure of 1.1 Gpa. The ball was driven at a speed of 200 $mms^{-1}$ over a stroke length of 4 mm and the disc frequency was 10 Hz. The measured wear scars obtained from each oil are set out in the table below.

| Oil | Wear scar/$\mu m^3$ |
|---|---|
| 1 | 61568 |
| 2 | 32260 |
| 3 | 32530 |
| 4 | 28147 |
| 5 | 12719 |
| 6 | 14156 |

The results show that as expected, an oil containing a conventional amount (800 ppm of phosphorus) of a phosphorus anti-wear additive (ZDDP) provides the lubricating oil with good wear protection (compare Oil 1 with Oil 2). However, the results also demonstrate that 1 wt. % of pre-ceramic polymer P1 is able to provide equivalent wear protection as the ZDDP (compare Oil 3 with Oil 2) and further that 1 wt. % of pre-ceramic polymers P2, P3 and P4 provide enhanced wear protection compared to the use of ZDDP (compare Oils 4, 5 and 6 with Oil 2). Especially advantageous wear protection is provided by pre-ceramic polymers P3 and P4. It has thus shown to be possible to entirely replace a conventional ZDDP anti-wear additive with a species that is phosphorus-free and metal-free without compromise to the ability of the oil to protect against wear.

The testing above was carried out on freshly formulated oils. While it is clearly important that a lubricating oil is able to protect contacting parts (e.g. in an engine) when the oil is new, it is also critical that the oil continues to provide protection from wear when the oil has been in use for a period of time. To investigate this, five further lubricating oils were formulated as shown in the table below. In addition to the anti-wear compounds listed in the table, all five lubricating oils contained similar amounts of an ashless dispersant, metal-containing detergents, anti-oxidants, and a viscosity modifier, all of the types and in amounts typically found in passenger car crankcase lubricating oils.

| Oil | Anti-wear compound/amount |
|---|---|
| 7 | none |
| 8 | ZDDP/to provide 400 ppm of phosphorus to the oil |
| 9 | ZDDP/to provide 800 ppm of phosphorus to the oil |
| 10 | P2/1 wt. % |
| 11 | ZDDP/to provide 400 ppm of phosphorus to the oil + P2/0.5 wt. % |

Oils 10 and 11 are examples of the present invention. Oils 7, 8 and 9 are comparative examples, with Oils 8 and 9 being representative of common commercial lubricating oils. The oils were tested using a High Frequency Reciprocating Rig (HFRR) available from PCS Instruments, London. The testing regime used was as follows.

a) Each oil was blended and the sample split into two portions. One portion of each oil was aged by heating to a temperature of 160° C. and blowing air through the oil at a rate of 10 litres/hour for 192 hours.
b) A 'run-in' procedure was performed whereby the fresh (un-aged) portion of the oil to be tested was used in the HFRR using standard steel substrates and balls: 200 g load, 20 Hz reciprocation, 1 mm stroke length at 100° C. for 30 minutes.
c) Following the run-in procedure, the fresh oil portion was replaced by the aged portion and HFRR testing continued on the same substrates and balls as used in stage b) under the same conditions but for 90 minutes.

Each oil was tested in the same way a further two times and the average wear scar volume was calculated. Results are shown in the table below.

| Oil | HFRR wear scar volume/$\mu m^3$ |
|---|---|
| 7 | 671935 |
| 8 | 509640 |
| 9 | 186605 |
| 10 | 139855 |
| 11 | 190155 |

The results show that as expected, the conventional anti-wear additive (ZDDP) is effective to protect against wear, and an increased amount of ZDDP (in terms of phosphorus content) provided additional protection (compare Oils 7, 8 and 9). The oil containing 1 w.t % the of pre-ceramic polymer (Oil 10) provided enhanced wear protection compared to the oil containing the highest amount of phosphorus (Oil 9) showing that the improvement in wear exhibited for the fresh oils persisted into aged oils. Comparing the results for Oils 11 and 9 shows that equivalent wear performance can be achieved by replacing half of the ZDDP (in terms of phosphorus content) with only 0.5 wt. of a pre-ceramic polymer. Entire or partial replacement of ZDDP has thus shown to be possible without compromising wear performance.

SEM-EDX analysis of the wear scars formed during HFRR testing showed increased levels of silicon present in scars formed during fresh oil testing (step b) above) and during aged oil testing (step c) above).

Fresh (un-aged) samples of Oils 8, 9 and 11 were tested using a 4-ball wear tester. This is a higher pressure boundary lubrication test then either the MTM or the HFRR. Results are shown in the table below.

| Oil | Average 90° wear scar/mm |
|---|---|
| 8 | 1.60 |
| 9 | 0.76 |
| 11 | 0.73 |

The results show that the oil containing 400 ppm of phosphorus (from ZDDP) and 0.5 wt. % of the pre-ceramic polymer (Oil 11) significantly outperformed the oil containing 400 ppm of phosphorus (Oil 8) and provided equivalent wear performance to an oil containing twice as much phosphorus (Oil 9).

What is claimed is:

1. A lubricating oil composition comprising a major amount of an oil of lubricating viscosity, a minor amount of a metal-free pre-ceramic polymer and one or more co-additives, wherein the metal-free pre-ceramic polymer contains a repeat unit of formula (I):

(I)

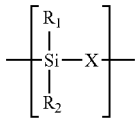

where X is NH, NR, $BR_3$ or $R_4$;

or wherein the metal-free pre-ceramic polymer contains a repeat unit of formula (II), (III), (IV):

(II)

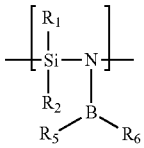

(III)

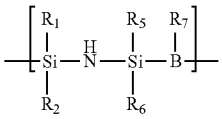

-continued (IV)

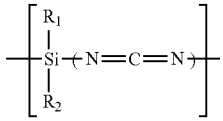

wherein R, $R_1$, $R_2$, $R_3$, $R_4$, $R_5$, $R_6$ and $R_7$ are independently linear, branched or cyclic alkyl or alkenyl groups, or aryl groups containing 1 to 30 carbon atoms, wherein said metal-free pre-ceramic polymer having a repeat unit of formula (I): is not capped with an amine or polyamine.

2. A lubricating oil composition according to claim 1 wherein the metal-free pre-ceramic polymer is capped at one or both ends by a capping or chain-terminating group.

3. A lubricating oil composition according to claim 1 wherein the number of repeat units of formulae (I) to (IV) in the metal-free pre-ceramic polymer is in the range from 2 to 100.

4. A lubricating oil composition according to claim 1 wherein at least one of R, $R_1$, $R_2$, $R_3$, $R_5$, $R_6$ and $R_7$ contains at least 3 carbon atoms, and/or any capping or chain-terminating group contains such a group.

5. A lubricating oil composition according to claim 1 wherein the metal-free pre-ceramic polymer is present in the lubricating oil composition in an amount of between 0.001 and 10 percent by weight, based on the weight of the composition.

6. A lubricating oil composition according to claim 1 wherein the one or more co-additives comprises an antiwear additive, an oil-soluble or oil-dispersible molybdenum-containing compound, a metal-containing detergent, an ashless dispersant, an ashless friction modifier, a viscosity modifier, an anti-oxidant, a rust inhibitor, a copper and lead bearing corrosion inhibitor, a demulsifier or a pour point depressant.

7. A lubricating oil composition according to claim 6 which does not contain a zinc dihydrocarbyl dithiophosphate.

8. A method of lubricating a spark-ignited or compression-ignited internal combustion engine, the method comprising lubricating the engine with a lubricating oil composition according to claim 1.

9. A lubricating oil composition of claim 1, wherein said metal-free pre-ceramic polymer is capped at one or both ends by a capping or chain-terminating group selected from the group consisting of an amide group, an ester, an ether, and a thioether.

10. A lubricating oil composition of claim 1, wherein said metal-free pre-ceramic polymer is capped at one or both ends by an amide group.

11. A lubricating oil composition of claim 10, wherein the number of repeat units of formulae (I) to (IV) in the metal-free pre-ceramic polymer from is from 2 to 5.

12. A lubricating oil composition of claim 10, wherein at least one of R, $R_1$, $R_2$, $R_3$, $R_5$, $R_6$ and $R_7$ contain at least 12 carbon atoms.

13. A lubricating oil composition of claim 10, wherein at least one of $R_1$ and $R_2$ contains at least 12 carbon atoms.

14. A method of lubricating a spark-ignited or compression-ignited internal combustion engine comprising lubricating the engine with the lubricating oil composition of claim 10.

15. A lubricating oil composition of claim 1, wherein the number of repeat units of formulae (I) to (IV) in the metal-free pre-ceramic polymer is from 2 to 100.

16. A lubricating oil composition of claim 1, wherein the number of repeat units of formulae (I) to (IV) in the metal-free pre-ceramic polymer from is from 2 to 5.

17. A lubricating oil composition of claim 1, wherein at least one of R, $R_1$, $R_2$, $R_3$, $R_5$, $R_6$ and $R_7$ contain at least 8 carbon atoms.

18. A lubricating oil composition of claim 1, wherein R contains at least 8 carbon atoms.

19. A lubricating oil composition of claim 1, wherein R contains at least 12 carbon atoms.

20. A lubricating oil composition of claim 1, wherein at least one of $R_1$ and $R_2$ contains at least 8 carbon atoms.

21. A lubricating oil composition comprising a major amount of an oil of lubricating viscosity, a minor amount of a metal-free pre-ceramic polymer and one or more co-additives, wherein the metal-free pre-ceramic polymer contains a repeat unit of formula (I):

(I)

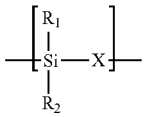

where X is NH, NR, $BR_3$ or $R_4$;

or wherein the metal-free pre-ceramic polymer contains a repeat unit of formula (II), (III), (IV):

(II)

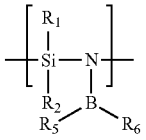

(III)

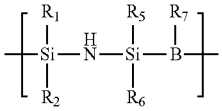

(IV)

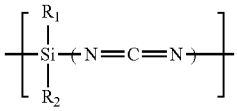

wherein R, $R_1$, $R_2$, $R_3$, $R_4$, $R_5$, $R_6$ and $R_7$ are independently linear, branched or cyclic alkyl or alkenyl groups, or aryl groups containing 1 to 30 carbon atoms, wherein the repeat units of formulae (I) to (VI) form a closed ring structure.

22. A lubricating oil composition comprising a major amount of an oil of lubricating viscosity, a minor amount of a metal-free pre-ceramic polymer and one or more co-additives, wherein the metal-free pre-ceramic polymer comprises a compound of structure (VII):

(VII)

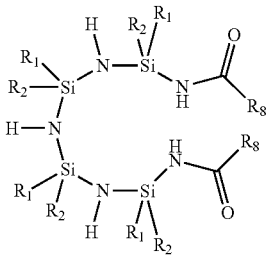

wherein $R_1$, $R_2$ and $R_8$ are independently hydrocarbyl groups containing 1 to 30 carbon atoms, provided that at least one of $R_1$, $R_2$ and $R_8$ contains at least 3.

23. A lubricating oil composition according to claim 22 wherein the metal-free pre-ceramic polymer is present in the lubricating oil composition in an amount of between 0.001 and 10 percent by weight, based on the weight of the composition.

24. A lubricating oil composition according to claim 22 wherein the one or more co-additives comprises an antiwear additive, an oil-soluble or oil-dispersible molybdenum-containing compound, a metal-containing detergent, an ashless dispersant, an ashless friction modifier, a viscosity modifier, an anti-oxidant, a rust inhibitor, a copper and lead bearing corrosion inhibitor, a demulsifier or a pour point depressant.

25. A lubricating oil composition according to claim 24 wherein the one or more co-additives comprises a zinc dihydrocarbyl dithiophosphate in an amount sufficient to provide from greater than 800 ppm to 1200 ppm by mass of phosphorous to the lubricating oil composition, based upon the total mass of the lubricating oil composition, and as measured in accordance with ASTM D5185.

26. A lubricating oil composition according to claim 24 wherein the one or more co-additives comprises a zinc dihydrocarbyl dithiophosphate in an amount sufficient to provide no greater than 800 ppm by mass of phosphorous to the lubricating oil composition, based upon the total mass of the lubricating oil composition, and as measured in accordance with ASTM D5185.

27. A lubricating oil composition according to claim 22 which does not contain a zinc dihydrocarbyl dithiophosphate.

28. A method of lubricating a spark-ignited or compression-ignited internal combustion engine, the method comprising lubricating the engine with a lubricating oil composition according to claim 22.

29. A lubricating oil composition comprising a major amount of an oil of lubricating viscosity, a minor amount of a metal-free pre-ceramic polymer and one or more co-additives, wherein the metal-free pre-ceramic polymer comprises a compound of structure (VIII):

(VIII)

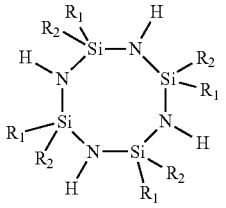

wherein $R_1$ and $R_2$ are independently hydrocarbyl groups containing 1 to 30 carbon atoms, provided that at least one of $R_1$ and $R_2$ contains at least 3 carbon atoms.

30. A lubricating oil composition according to claim 29 wherein the metal-free pre-ceramic polymer is present in the lubricating oil composition in an amount of between 0.001 and 10 percent by weight, based on the weight of the composition.

31. A lubricating oil composition according to claim 29 wherein the one or more co-additives comprises an antiwear additive, an oil-soluble or oil-dispersible molybdenum-containing compound, a metal-containing detergent, an ashless dispersant, an ashless friction modifier, a viscosity modifier, an anti-oxidant, a rust inhibitor, a copper and lead bearing corrosion inhibitor, a demulsifier or a pour point depressant.

32. A lubricating oil composition according to claim 31 wherein the one or more co-additives comprises a zinc dihydrocarbyl dithiophosphate in an amount sufficient to provide from greater than 800 ppm to 1200 ppm by mass of phosphorous to the lubricating oil composition, based upon the total mass of the lubricating oil composition, and as measured in accordance with ASTM D5185.

33. A lubricating oil composition according to claim 31 wherein the one or more co-additives comprises a zinc dihydrocarbyl dithiophosphate in an amount sufficient to provide no greater than 800 ppm by mass of phosphorous to the lubricating oil composition, based upon the total mass of the lubricating oil composition, and as measured in accordance with ASTM D5185.

34. A lubricating oil composition according to claim 29 which does not contain a zinc dihydrocarbyl dithiophosphate.

35. A method of lubricating a spark-ignited or compression-ignited internal combustion engine, the method comprising lubricating the engine with a lubricating oil composition according to claim 29.

36. A lubricating oil composition comprising a major amount of an oil of lubricating viscosity, a minor amount of a metal-free pre-ceramic polymer and one or more co-additives, wherein the metal-free pre-ceramic polymer comprises a mixture of a compound of structure (VII):

(VII)

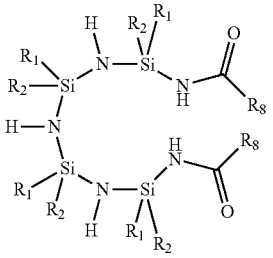

wherein $R_1$, $R_2$ and $R_8$ are independently hydrocarbyl groups containing 1 to 30 carbon atoms, provided that at least one of $R_1$, $R_2$ and $R_8$ contains at least 3 carbon atoms; and a compound of structure (VIII):

(VIII)

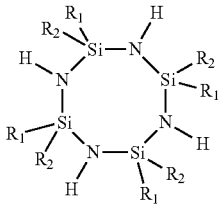

wherein $R_1$ and $R_2$ are independently hydrocarbyl groups containing 1 to 30 carbon atoms, provided that at least one of $R_1$ and $R_2$ contains at least 3 carbon atoms.

37. A lubricating oil composition according to claim 36 wherein the metal-free pre-ceramic polymer is present in the lubricating oil composition in an amount of between 0.001 and 10 percent by weight, based on the weight of the composition.

38. A lubricating oil composition according to claim 36 wherein the one or more co-additives comprises an antiwear additive, an oil-soluble or oil-dispersible molybdenum-containing compound, a metal-containing detergent, an ashless dispersant, an ashless friction modifier, a viscosity modifier, an anti-oxidant, a rust inhibitor, a copper and lead bearing corrosion inhibitor, a demulsifier or a pour point depressant.

39. A lubricating oil composition according to claim 38 wherein the one or more co-additives comprises a zinc dihydrocarbyl dithiophosphate in an amount sufficient to provide from greater than 800 ppm to 1200 ppm by mass of phosphorous to the lubricating oil composition, based upon the total mass of the lubricating oil composition, and as measured in accordance with ASTM D5185.

40. A lubricating oil composition according to claim 38 wherein the one or more co-additives comprises a zinc dihydrocarbyl dithiophosphate in an amount sufficient to provide no greater than 800 ppm by mass of phosphorous to the lubricating oil composition, based upon the total mass of the lubricating oil composition, and as measured in accordance with ASTM D5185.

41. A lubricating oil composition according to claim 36 which does not contain a zinc dihydrocarbyl dithiophosphate.

42. A method of lubricating a spark-ignited or compression-ignited internal combustion engine, the method comprising lubricating the engine with a lubricating oil composition according to claim 36.

43. A lubricating oil composition comprising a major amount of an oil of lubricating viscosity, a minor amount of a metal-free pre-ceramic polymer and one or more co-additives, wherein the metal-free pre-ceramic polymer contains a repeat unit of formula (I):

(I)

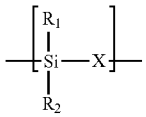

where X is NH, NR, $BR_3$ or $R_4$;

or wherein the metal-free pre-ceramic polymer contains a repeat unit of formula (II), (III), (IV):

(II)

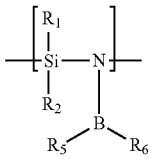

(III)

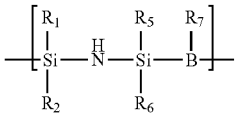

(IV)

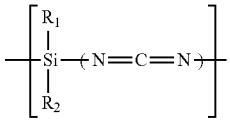

wherein R, $R_1$, $R_2$, $R_3$, $R_4$, $R_5$, $R_6$ and $R_7$ are independently linear, branched or cyclic alkyl or alkenyl groups, or aryl groups containing 1 to 30 carbon atoms, wherein: 1) the one or more co-additives comprises an oil-soluble or oil-dispersible molybdenum-containing compound, a metal-containing detergent, an ashless dispersant, an ashless friction modifier, a viscosity modifier, an anti-oxidant, a rust inhibitor, a copper and lead bearing corrosion inhibitor, a demulsifier or a pour point depressant, 2) the one or more co-additives comprises a zinc dihydrocarbyl dithiophosphate in an amount sufficient to provide from greater than 800 ppm to 1200 ppm by mass of phosphorous to the lubricating oil composition, based upon the total mass of the lubricating oil composition, and as measured in accordance with ASTM D5185, and 3) said metal-free pre-ceramic polymer having a repeat unit of formula (I): is not capped with an amine or polyamine.

44. A lubricating oil composition comprising a major amount of an oil of lubricating viscosity, a minor amount of a metal-free pre-ceramic polymer and one or more co-additives, wherein the metal-free pre-ceramic polymer contains a repeat unit of formula (I):

(I)

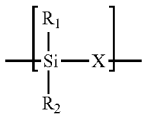

where X is NH, NR, $BR_3$ or $R_4$;

or wherein the metal-free pre-ceramic polymer contains a repeat unit of formula (II), (III), (IV):

(II)

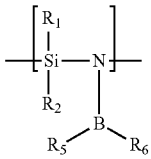

-continued (III)

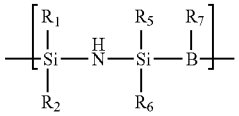

(IV)

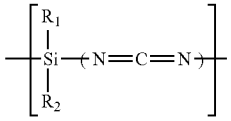

wherein R, $R_1$, $R_2$, $R_3$, $R_4$, $R_5$, $R_6$ and $R_7$ are independently linear, branched or cyclic alkyl or alkenyl groups, or aryl groups containing 1 to 30 carbon atoms, wherein: 1) the one or more co-additives comprises an oil-soluble or oil-dispersible molybdenum-containing compound, a metal-containing detergent, an ashless dispersant, an ashless friction modifier, a viscosity modifier, an anti-oxidant, a rust inhibitor, a copper and lead bearing corrosion inhibitor, a demulsifier or a pour point depressant, 2) the one or more co-additives comprises a zinc dihydrocarbyl dithiophosphate in an amount sufficient to provide no greater than 800 ppm by mass of phosphorous to the lubricating oil composition, based upon the total mass of the lubricating oil composition, and as measured in accordance with ASTM D5185, and 3) said metal-free pre-ceramic polymer having a repeat unit of formula (I): is not capped with an amine or polyamine.

45. A lubricating oil composition comprising a major amount of an oil of lubricating viscosity, a minor amount of a metal-free pre-ceramic polymer, a zinc dihydrocarbyl dithiophosphate, and one or more co-additives, wherein the metal-free pre-ceramic polymer contains a repeat unit of formula (II), (III), (IV):

(II)

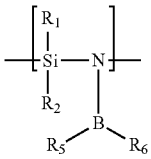

(III)

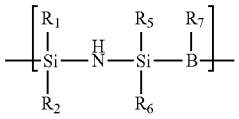

(IV)

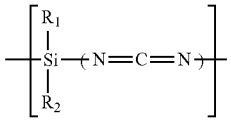

wherein R, $R_1$, $R_2$, $R_3$, $R_4$, $R_5$, $R_6$ and $R_7$ are independently linear, branched or cyclic alkyl or alkenyl groups, or aryl groups containing 1 to 30 carbon atoms wherein said metal-free pre-ceramic polymer is capped at one or both ends by a capping or chain-terminating group selected from the group consisting of an amine or polyamine.

46. A lubricating oil composition comprising a major amount of an oil of lubricating viscosity, a minor amount of a metal-free pre-ceramic polymer and one or more co-additives, wherein the metal-free pre-ceramic polymer is a closed ring structure consisting of a repeat unit of formula (I):

(I)

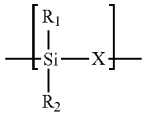

where X is NH, NR, $BR_3$ or $R_4$; and said metal-free pre-ceramic polymer is capped at one or both ends by a capping or chain-terminating group selected from the group consisting of an amide group, an amine or polyamine, an ester, an ether, a thioether and a polymeric residue.

47. A lubricating oil composition according to claim 46 wherein where X is NH or NR.

48. A lubricating oil composition of claim 46, wherein said metal-free pre-ceramic polymer is capped at one or both ends by an amide group.

49. A lubricating oil composition of claim 46, wherein the number of repeat units of formulae (I) to (IV) in the metal-free pre-ceramic polymer from is from 2 to 5.

50. A lubricating oil composition of claim 46, wherein at least one of R, $R_1$, $R_2$, $R_3$, $R_5$, $R_6$ and $R_7$ contain at least 12 carbon atoms.

51. A lubricating oil composition of claim 46, wherein: 1) the one or more co-additives comprises an oil-soluble or oil-dispersible molybdenum-containing compound, a metal-containing detergent, an anti-wear additive, an ashless dispersant, an ashless friction modifier, a viscosity modifier, an anti-oxidant, a rust inhibitor, a copper and lead bearing corrosion inhibitor, a demulsifier or a pour point depressant.

52. A lubricating oil composition of claim 51, wherein the one or more co-additives comprises a zinc dihydrocarbyl dithiophosphate in an amount sufficient to provide from greater than 800 ppm to 1200 ppm by mass of phosphorous to the lubricating oil composition, based upon the total mass of the lubricating oil composition, and as measured in accordance with ASTM D5185.

53. A lubricating oil composition of claim 51, wherein the one or more co-additives comprises a zinc dihydrocarbyl dithiophosphate in an amount sufficient to provide no greater than 800 ppm by mass of phosphorous to the lubricating oil composition, based upon the total mass of the lubricating oil composition, and as measured in accordance with ASTM D5185.

54. A lubricating oil composition comprising a major amount of an oil of lubricating viscosity, a minor amount of a metal-free pre-ceramic polymer and one or more co-additives, wherein the metal-free pre-ceramic polymer contains a repeat unit of formula (I):

(I)

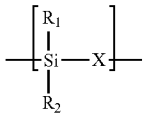

where X is NH, NR, $BR_3$ or $R_4$;

or wherein the metal-free pre-ceramic polymer contains a repeat unit of formula (II), (III), (IV):

(II)

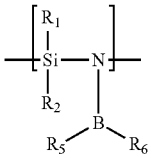

(III)

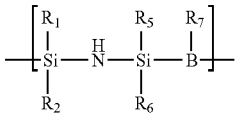

(IV)

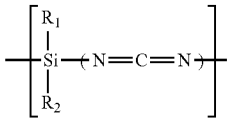

wherein R, $R_1$, $R_2$, $R_3$, $R_4$, $R_5$, $R_6$ and $R_7$ are independently linear, branched or cyclic alkyl or alkenyl groups, or aryl groups containing 1 to 30 carbon atoms, where said metal-free pre-ceramic polymer is capped at one or both ends by a capping or chain-terminating group selected from the group consisting of an amide group, an ester, an ether, a thioether and a polymeric residue.

* * * * *